US008720990B2

(12) United States Patent
Boydston

(10) Patent No.: US 8,720,990 B2
(45) Date of Patent: May 13, 2014

(54) COMBINATION BENCH AND TABLE

(75) Inventor: Kevin Boydston, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 217 days.

(21) Appl. No.: 13/170,124

(22) Filed: Jun. 27, 2011

(65) Prior Publication Data

US 2011/0316312 A1 Dec. 29, 2011

Related U.S. Application Data

(60) Provisional application No. 61/359,283, filed on Jun. 28, 2010.

(51) Int. Cl.
*A47B 83/02* (2006.01)

(52) U.S. Cl.
USPC ..... 297/173; 297/172; 297/124

(58) Field of Classification Search
USPC ..... 297/173, 172, 24, 124
See application file for complete search history.

(56) References Cited

U.S. PATENT DOCUMENTS

| | | | | | |
|---|---|---|---|---|---|
| 2,486,468 | A | * | 11/1949 | Freedman | 297/124 X |
| 2,675,859 | A | | 4/1954 | Abler | |
| 2,758,633 | A | * | 8/1956 | Apple | 297/124 |
| 2,856,985 | A | * | 10/1958 | Lepper | 297/124 |
| 3,361,470 | A | * | 1/1968 | Erickson et al. | 297/124 |
| 4,382,627 | A | | 5/1983 | Dean | |
| 4,801,175 | A | * | 1/1989 | Albanese | 297/124 X |
| 4,913,488 | A | * | 4/1990 | Donnell, Jr. | 297/124 X |
| 5,292,172 | A | | 3/1994 | Watts et al. | |
| 5,692,799 | A | | 12/1997 | Sheets | |
| 6,189,965 | B1 | | 2/2001 | Hecht et al. | |
| 6,231,121 | B1 | | 5/2001 | Chrisco et al. | |
| 6,241,312 | B1 | | 6/2001 | Watts et al. | |
| 6,659,543 | B2 | | 12/2003 | McCutcheon et al. | |
| 7,429,077 | B2 | | 9/2008 | Yul | |

FOREIGN PATENT DOCUMENTS

FR 2579436 10/1986

OTHER PUBLICATIONS

International Search Report and Written Opinion from PCT/US2011/042154, dated Dec. 2, 2011.

* cited by examiner

*Primary Examiner* — Anthony D Barfield
(74) *Attorney, Agent, or Firm* — Maschoff Brennan

(57) ABSTRACT

A combination bench and table may include a platform that is movable between a bench configuration and a table configuration. The platform may form a backrest in the bench configuration and a table in the table configuration. The platform may be supported by a cantilever support member that extends upwardly at an angle and a connecting assembly preferably connects the platform and the cantilever support member. The connecting assembly may allow the platform to pivot about an axis and the axis may be disposed proximate a front edge of the table and the lower portion of the backrest. The axis may also be generally vertically aligned with a midpoint of a connecting member of the frame. Further, the axis may be generally horizontally aligned with a lower edge of the backrest when the combination bench and table is disposed in the bench configuration.

18 Claims, 12 Drawing Sheets

COMBINATION BENCH AND TABLE

CROSS-REFERENCE TO RELATED APPLICATIONS

The present invention claims priority to and the benefit of U.S. Provisional Patent Application Ser. No. 61/359,283, entitled Convertible Picnic Table, which was filed on Jun. 28, 2010, and is hereby incorporated by reference in its entirety.

BACKGROUND OF THE INVENTION

1. Field of the Invention

The present invention generally relates to furniture such as tables and benches. In particular, the present invention relates to a combination bench and table.

2. Description of Related Art

Conventional picnic tables typically include a table top, seats and a support structure connecting the table top and seats. The support structure of many conventional picnic tables is rather large and obstructive, which can make the picnic table difficult and awkward to use.

Picnic tables are often used because the seating and table are combined into a single unit. This may make the picnic table convenient for activities such as eating and drinking. Picnic tables also offer the advantage of being able to seat a large number of people around a table. Conventional picnic tables are generally used outdoors and have become increasingly popular as more and more people spend their leisure time outside. For example, picnic tables are often located in backyards and parks. These picnic tables may provide a convenient place to sit and eat while enjoying a meal. Once the meal is finished, however, conventional picnic tables may not provide the comfort and relaxation provided by other patio or deck furniture. Further, because of the relatively large size of conventional picnic tables, the picnic table may limit the amount of available space on a patio or deck, in a backyard.

Conventional picnic tables are often difficult to move because of their large size and heavy weight. Picnic tables may also have a limited number of uses because of their large size, shape and configuration. That is, because most picnic tables may only be disposed in a single configuration, the potential uses of the picnic table may be quite narrow or restricted.

Benches are often used to provide comfortable and relaxing sitting areas. Conventional benches typically include a seat and a backrest. Unfortunately, such benches have a limited number of uses. For example, benches may not provide a comfortable area to enjoy a meal.

It is known to combine picnic tables and benches into a single structure, but these known structures often have many disadvantages. For example, previous furniture that is convertible between a bench structure and a table structure may not provide a quick and easy means for converting the furniture between the different configurations. For example, known convertible furniture may require a number of complicated mechanical components to allow the furniture to be converted between the bench and table structures. Disadvantageously, these complicated structures, which may include a number of small parts, are frequently difficult, time-consuming and expensive to manufacture. In addition, known convertible furniture is often awkward and cumbersome to use and operate. Further, known convertible furniture may require a significant amount of space and may require two or more people to move the furniture between the different configurations. Finally, known convertible furniture may be uncomfortable to use. For example, the bench may provide a seat that is painful to sit on, especially for extended periods of time, and the table may be difficult to use because of the spacing and distance between the seat and table.

BRIEF SUMMARY OF EMBODIMENTS OF THE INVENTION

A need therefore exists for an apparatus that eliminates or diminishes the disadvantages and problems described above.

One aspect is a combination bench and table that may include a bench configuration and a table configuration. Preferably, the combination bench and table is readily movable between the bench and table configurations. In the bench configuration, the bench may include a seat for one, two or more persons. The bench may also include a backrest. The backrest may be spaced apart from the seat by a distance and the backrest may be disposed at an angle relative to the seat. The table configuration may include seat for one, two or more persons and a table disposed in a generally horizontal position.

Another aspect is combination bench and table that may be quickly and easily moved between the bench configuration and the table configuration. For example, a person may simply move a handle to allow the structure to be moved between the different configurations. Advantageously, moving the structure between the bench and table configurations may be accomplished by a single person.

Still another aspect is a combination bench and table that may include a structure that forms the backrest in the bench configuration and the table in the table configuration. The structure may be pivotally disposed in a unique position about a single pivot point or axis to create the backrest and table. For example, the pivot point or axis may be disposed proximate the lower portion of the backrest and front edge of the table. Significantly, this location may allow rapid and convenient movement between the bench and table configurations.

Yet another aspect is combination bench and table that may include a frame that connects the seat and the structure that forms the backrest and table. The frame preferably includes a distinctive cantilever design, which may allow the combination bench and table structure to be conveniently used. For instance, the cantilevered portion of the frame may be angled upwardly and that may allow for ease of use when the structure is in the table configuration. The unique cantilever design may also allow the pivot point or axis of the movable backrest and table to be correctly positioned. In addition, the frame may provide a sturdy and stable base for the bench and table structure. Further, the frame may provide unobstructed leg room for persons sitting on the seat in the table configuration and it may allow the structure to be quickly and easily moved between the bench and table configurations.

A further aspect is a picnic table that may include a seat and a table top. The table top may be movable between a plurality of different positions. For example, the table top may be disposed in a generally horizontal position, which may facilitate using the structure as a picnic table. The table top may also be disposed in a generally upright or vertical position in which the table top may be used as a backrest. In greater detail, when the table top is in the generally horizontal position, the table top may be at least substantially parallel to an upper surface of the seat and/or a support surface upon which the picnic table rests. When the table top is in the generally upright or vertical position, the table top may be disposed at an angle between about 90 and about 110 degrees relative to the upper surface of the seat and/or the support surface. That is, the table top may be disposed generally perpendicular or at an angle relative to the seat, which may help create a comfortable bench for a user. One of ordinary skill in the art will appreciate, after reading this disclosure, that the table top may be disposed among a variety of positions relative to the seat and/or the support surface. For example, the table top may be slanted towards or away from the bench depending, for example, upon the intended use of the picnic table.

A still further aspect is a combination bench and table that may include a support structure which connects the seat and the movable structure which forms the table and backrest. This movable structure that forms the table and backrest may be referred to as a platform. The support structure may include a first set of one or more legs that support the seat and a second set of one or more legs that support the platform. The support structure may include one or more cantilevered supports, which may advantageously provide additional legroom and/or easier entry in the table configuration. The cantilevered supports may be disposed at an upwardly extending angle and may facilitate connection of the platform and the support structure. One of ordinary skill in the art will appreciate, after reading this disclosure, that the cantilevered supports are not required and the support structure may be connected to other suitable portions of the platform.

Another further aspect is a combination bench and table that may include a connecting assembly that is sized and configured to connect the platform and the support structure. The connecting assembly may facilitate movement of the platform between the bench and table configurations. In particular, the connecting assembly may allow the platform to pivot or rotate relative to the support structure. The connecting assembly may also be sized and configured to lock the platform in one or more positions. For example, the connecting assembly may lock the platform in the bench configuration and/or the table configuration. The connecting assembly may also lock the platform in one or more positions within a range of positions and/or in a relatively few, discrete positions such as in the bench configuration and in the table configuration.

Yet another further aspect is a combination bench and table that may include a connecting assembly with one or more brackets. For example, the connecting assembly may include a first set of one or more brackets connected to the platform and a second set of one or more brackets connected to the support structure. The first and second sets of brackets may be connected. For example, the first and second sets of brackets may be rotatably or pivotally connected using one or more fasteners, pins and/or the like. Advantageously, the brackets may allow the platform to rotate relative to the support structure. In particular, the brackets may allow the platform to rotate relative to the cantilevered portion of the support structure.

Another aspect is a combination bench and table may include a connecting assembly with a locking member that is movable between locked and unlocked positions. For instance, the connecting assembly may include a first set of brackets with elongated slots or guides and the locking member may move and/or slide within elongated slots or guides as the locking member moves between the locked and unlocked positions. The locking member, in the locked position, may engage one or more receiving portions, such as notches, formed in a second set of brackets. This may lock the first and second brackets in a first position, such as the bench configuration. The locking member, in the unlocked position, may be spaced apart and/or disengaged from the receiving portions, which may allow the brackets to pivot or more. For instance, the brackets may allow the platform to rotate or move relative to the support structure, which may allow the platform to be moved into a second position, such as the table configuration. The locking member may then be used to lock the brackets into another fixed position, such as the bench configuration. The connecting assembly may include a biasing member which is sized and configured to bias the locking member towards a locked position. The biasing member may comprise, for instance, a spring with a first end that is connected to the locking member and a second end that is connected to a pin or fastener. Desirably, the pin or fastener pivotally connects the brackets of the connecting assembly.

Still another aspect is a combination bench and table that may include a handle that is used to lock and/or unlock the structure. For example, the handle may move the locking member of the connecting assembly between the locked and unlocked positions. Specifically, the rotation of the handle may move the locking member between the locked and unlocked positions. In addition, the handle may be used to simultaneously lock and unlock a plurality of connecting assemblies. For instance, the handle may be connected to an elongated member, such as a rod or tube, which may allow one or more connecting assemblies to be concurrently locked and/or unlocked. The elongated member may be connected to the locking member of the connecting assembly by, for example, a clevis arrangement.

Still yet another aspect is a combination bench and table that may include a handle on each side of the structure to facilitate locking and unlocking of the structure. For example, a handle could be disposed on each end of the elongated rod and a user could grasp either handle to lock or unlock the structure. Preferably, the handles are disposed at least proximate each side of the structure, which may allow the combination bench and table to be locked and unlocked from either or both sides. While the combination bench and table preferably allows the connecting assemblies to be simultaneously locked and unlocked, the structure could include connecting assemblies that are individually locked and unlocked.

These and other aspects, features and advantages of the present invention will become more fully apparent from the following brief description of the drawings, the drawings themselves and the appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limits its scope. Additionally, it will be appreciated that while the drawings may illustrate preferred sizes, scales, relationships and configurations of the invention, the drawings are not intended to limit the scope of the claimed invention. Further, the drawings may be to scale and may illustrate preferred arrangements of the invention, but the drawings are not necessarily to scale and the invention may have other suitable arrangements. The invention will be described and explained with additional specificity and detail through the use of the accompanying drawings in which:

DETAILED DESCRIPTION OF THE PREFERRED EMBODIMENTS

The present invention is directed towards a combination bench and table. The principles of the present invention, however, are not limited to a combination bench and table. For example, it will be understood that, in light of the present disclosure, the combination bench and table disclosed herein can have other suitable shapes, sizes, configurations and arrangements. Further, the structure may comprise a table, picnic table, bench and the like.

Additionally, to assist in the description of the combination bench and table, words such as top, bottom, front, rear, right and left are used to describe the accompanying figures. It will be appreciated that the present invention can be located in a variety of desired positions, including various angles, sideways and even upside down. Further, while the accompanying drawings may be to scale, the drawings are not necessarily to scale. A detailed description of the combination bench and table now follows.

Figure 1:
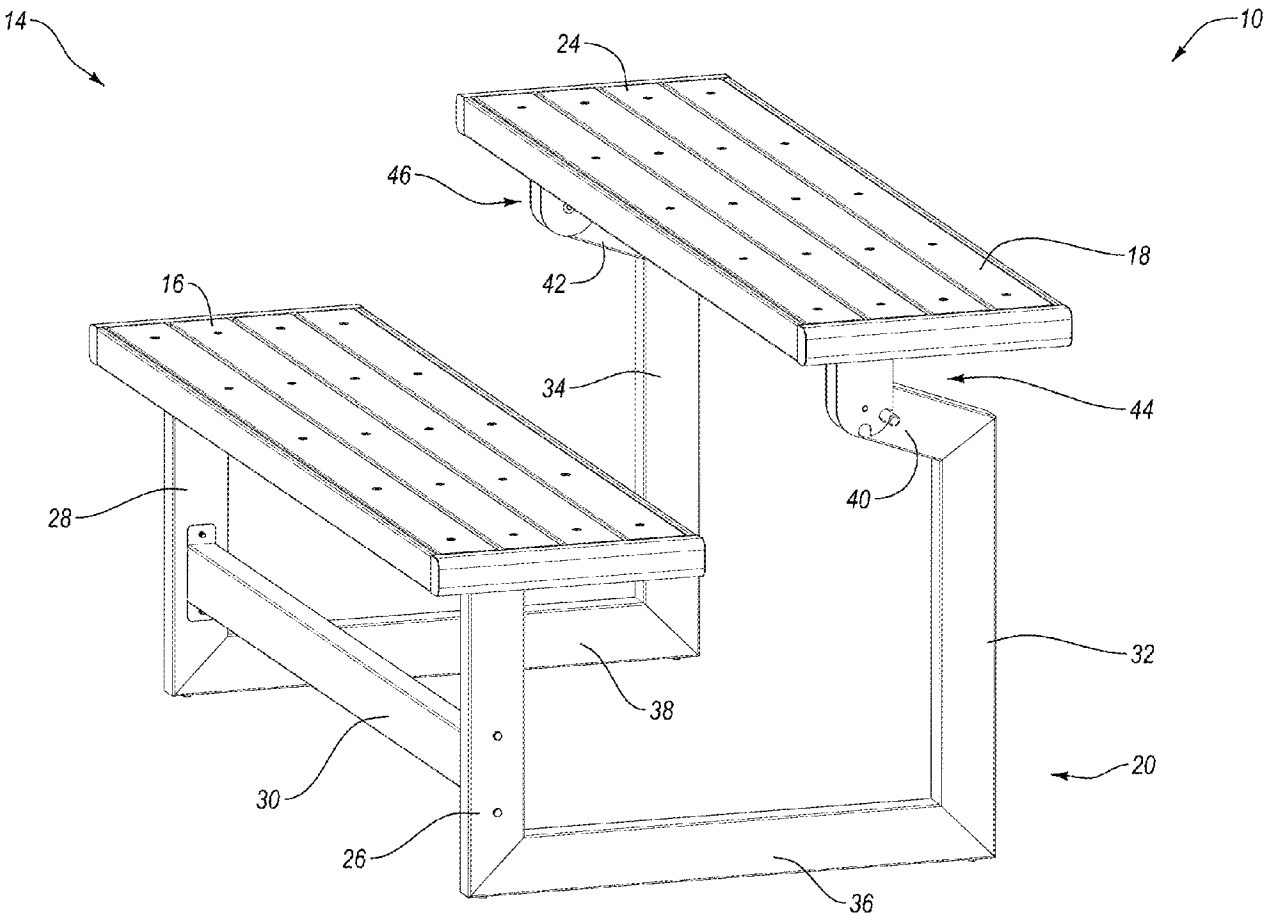
FIG. 1 is a perspective view of an exemplary embodiment of a combination bench and table, illustrating a table configuration.
Figure 2:
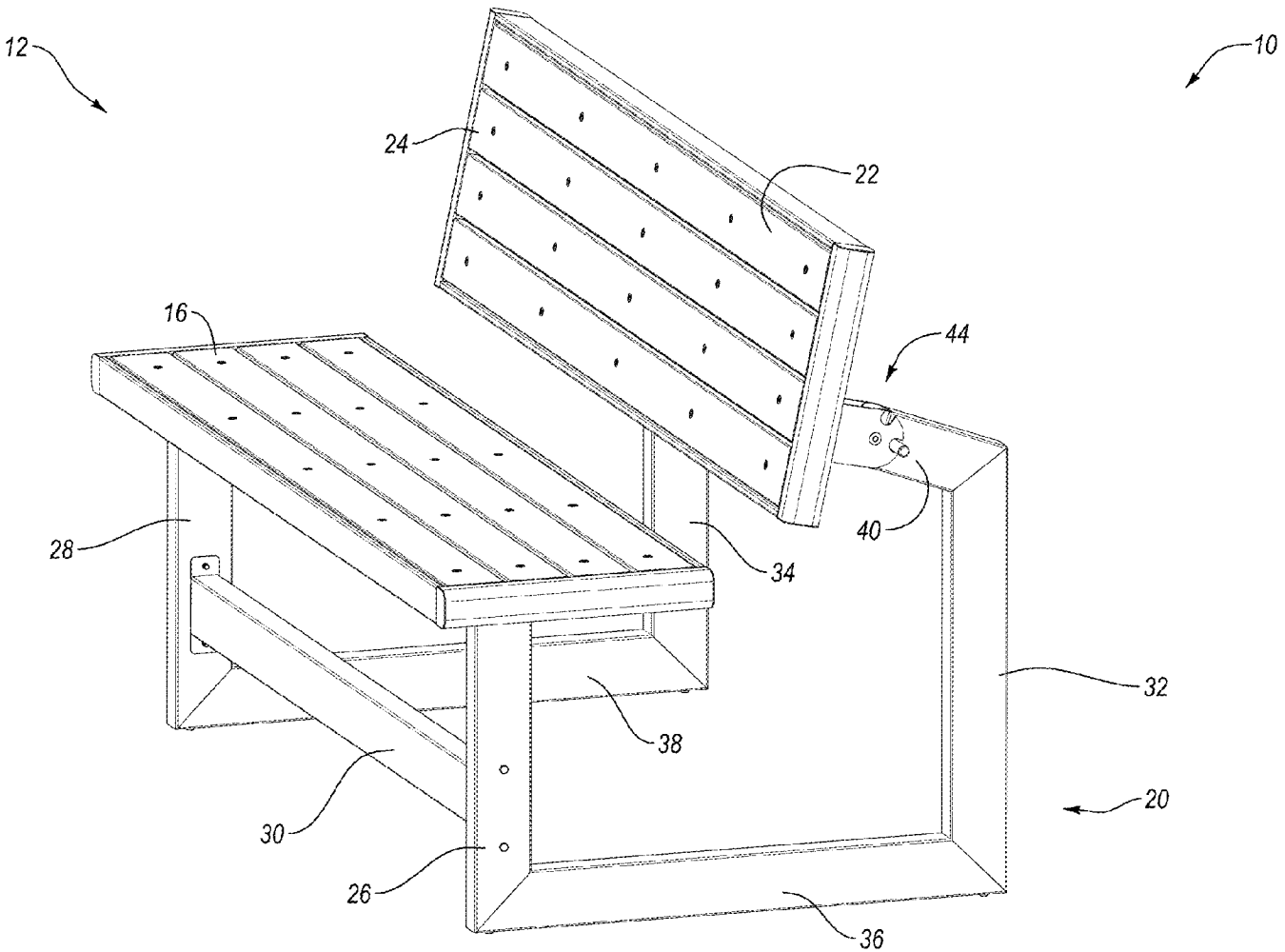
FIG. 2 is a perspective view of the combination bench and table shown in FIG. 1, illustrating a bench configuration.

The combination bench and table 10 may be disposed in a first configuration or position to form a bench 12, as illustrated in FIG. 2, and a second configuration or position to form a table 14, as illustrated in FIG. 1. The combination bench and table 10 is preferably movable between the table and bench configurations. As discussed in greater detail below, the combination bench and table 10 may be locked in the bench and table configurations, which may allow the combination bench and table to be used in a number of different environments, locations and circumstances. Advantageously, the combination bench and table 10 may be used for a number of different purposes and functions. For example, in the bench configuration, one or more users may sit on the bench for relaxation, reading and the like. In the table configuration, one or more users may sit at the table for eating, writing or performing other tasks in which it is convenient to sit at and use a table.

As shown in FIG. 1, in the table configuration, the table 14 may include a seat 16 and a table top 18. A frame 20 may be used to connect the seat 16 and the table top 18. In the bench configuration shown in FIG. 2, the bench 12 may include the seat 16, the frame 20 and a backrest 22. Advantageously, the same structure, which may be referred to as a platform 24 for convenience, may form the table top 18 when it is disposed in a generally horizontal position and the backrest 22 when it is disposed in a generally vertical position. That is, the platform 24 may form the table top 18 and the backrest 22 depending upon the configuration of the combination bench and table 10.

In greater detail, the platform 24 is preferably readily movable between a first position, such as the bench configuration shown in FIG. 2, and a second position, such as the table configuration shown in FIG. 1. When the platform 24 forms the backrest 22 of the bench 12, it is preferably spaced apart from the seat 16 by a distance. In addition, the backrest 22 is preferably disposed at an angle relative to the seat 16. For example, an upper surface of the seat 16 may be disposed in a generally horizontal configuration and the backrest 22 may be disposed at an angle between about 90 degrees and about 120 degrees relative to the upper surface of the seat 16. Preferably, the backrest 22 is disposed at approximately a 100 degree angle relative to the upper surface of the seat 16 to form a comfortable backrest for a user of the bench 12.

The frame 20 may include a first leg 26 connected to a first portion of the seat 16 and a second leg 28 connected to a second portion of the seat. The first and second legs 26, 28 may be connected by a cross member 30, which may be connected to an inner surface of the first and second legs. The first and second legs 26, 28 are preferably disposed beneath the seat 16 to create a sturdy and stable seat. While the seat 16 is shown in the accompany figures as being supported by a first pair of legs 26, 28 that are connected by the cross member 30, it will be understood that any suitable number and type of legs and cross members may be used to support the seat.

The frame 20 may also include a first generally upright support member 32 and a second generally upright support member 34 that are sized and configured to help support the platform 24. As shown in the accompanying figures, a first connecting member 36 may connect the first leg 26 and the first generally upright support member 32. In addition, a second connecting member 38 may connect the second leg 28 and the second generally upright support member 34.

The frame 20 may further include a first cantilever support member 40 and a second cantilever support member 42. The first and second cantilever support members 40, 42 preferably include a first end that is connected to the first and second generally upright support members 32, 34, respectively, and a second end that is preferably connected to the platform 24. Thus, the first and second legs 26, 28; the first and second generally upright support members 32, 34; the first and second connecting members 36, 38; and the first and second cantilever support members 40, 42 may form the frame 20. The frame 20 is preferably constructed from relatively strong and durable materials, such as metal, steel and/or plastic; and the frame may be formed from components that have a generally rectangular cross-sectional configuration. The frame 20 may also be formed from any suitable number of components and the frame may have other shapes, sizes, configurations and arrangements depending, for example, upon the intended use of the combination bench and table 10.

When the combination bench and table 10 is in the bench configuration, as shown in FIG. 2, the first and second generally upright support members 32, 34 and the first and second cantilever support members 40, 42 are preferably located behind the backrest 22. That is, these components may be disposed behind a plane generally aligned with the backrest 22. Advantageously, this may create a stable bench 12 with a securely supported seat 16 and backrest 22. In addition, if the first and second generally upright support members 32, 34 and the first and second cantilever support members 40, 42 are located behind the backrest 22, that may minimize or eliminate any portions of the frame 20 from interfering with the use of the bench 12.

As shown in FIG. 1, when the combination bench and table 10 is in the table configuration, the first and second cantilever support members 40, 42 are preferably disposed underneath the table top 18. In addition, the first and second generally upright support members 32, 34 are preferably disposed underneath the table top 18. Advantageously, if the generally upright support members 32, 34 and the first and second cantilever support members 40, 42 are located underneath the table top 18, a strong and sturdy table 14 may be formed. Significantly, the first and second cantilever support members 40, 42 may increase the legroom for users of the table 14. Additionally, the first and second cantilever support members 40, 42 may help create a frame 20 that does not interfere with sitting at the table 14. Further, the first and second cantilever support members 40, 42 may provide easy access to the table 14 because a large entryway or opening is created.

The first and second cantilever support members 40, 42 are preferably angled upwardly at an angle between about 30 degrees and about 60 degrees relative to horizontal. In particular, the first and second cantilever support members 40, 42 may be angled upwardly at an angle of about 45 degrees. It will be appreciated the angle of the first and second cantilever support members 40, 42 may depend, for example, upon the intended use and/or configuration of the combination bench and table 10.

The platform 24 is preferably connected to the frame 20 by at least one connecting assembly. In greater detail, the first cantilever support member 40 may be connected to the platform 24 by a first connecting assembly 44 and the second cantilever support member 42 may be connected to the platform by a second connecting assembly 46. The first and second connecting assemblies 44, 46 may facilitate movement of the platform 24 between the bench and table configurations. For example, the first and second connecting assemblies 44, 46 may allow the platform 24 to move between the bench and table configurations. In particular, the first and second connecting assemblies 44, 46 may allow the platform 24 to rotate or pivot about an axis, which may allow the platform to form the table top 18 or the backrest 22.

The first and second connecting assemblies 44, 46 are preferably disposed in unique and distinctive positions. The positioning of the first and second connecting assemblies 44, 46 may provide many advantages. For example, the positioning of the first and second connecting assemblies 44, 46 may allow the platform 24 to pivot about a single axis. Additionally, if the first and second connecting assemblies 44, 46 are disposed at least proximate the lower portion of the backrest 22 and the front edge of the table top 18, this may help create the large opening or entryway to the table 14. The positioning of the first and second connecting assemblies 44, 46 at least proximate the lower portion of the backrest 22 and the front edge of the table top 18 may allow the backrest 22 to be located such that a comfortable bench 12 is created. In addition, because the first and second connecting assemblies 44, 46 are preferably connected to the upper portion of the first and second cantilever support members 40, 42, this may provide increased legroom.

As shown in the accompanying figures, the frame 20 is preferably disposed towards the sides of the seat 16 and platform 24. In addition, the first and second connecting assemblies 44, 46 are preferably disposed towards the sides of the platform 24. This configuration and arrangement of the frame 22 and connecting assemblies 44, 46 may allow a strong and durable combination bench and table 10 to be constructed.

Figure 6:
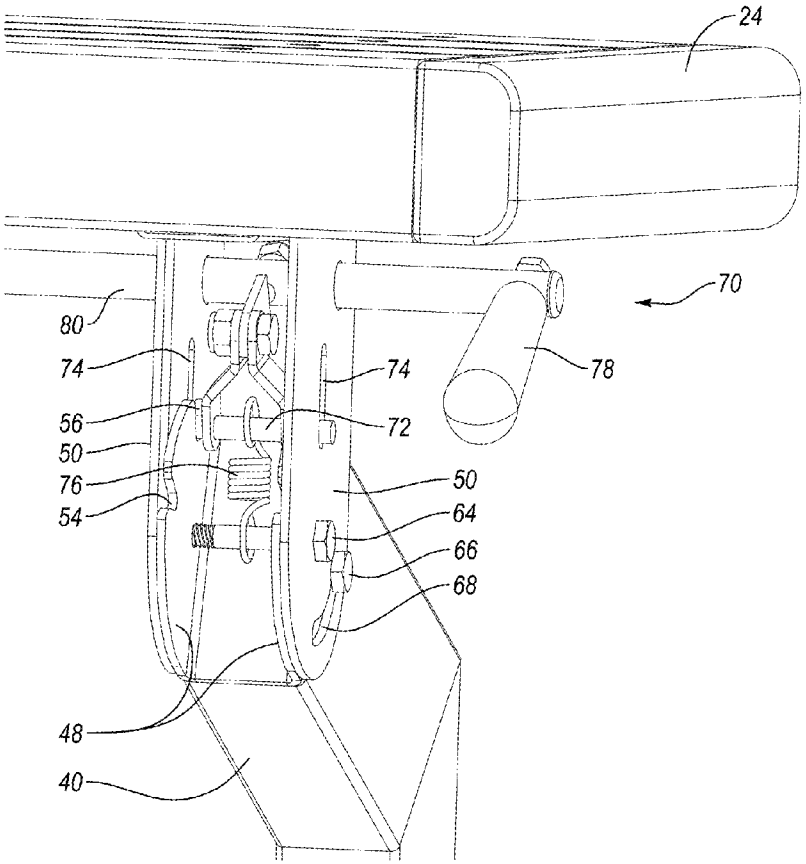
FIG. 6 is an enlarged perspective view of a portion of the combination bench and table shown in FIG. 5, illustrating the handle and locking mechanism in a first position.
Figure 7:
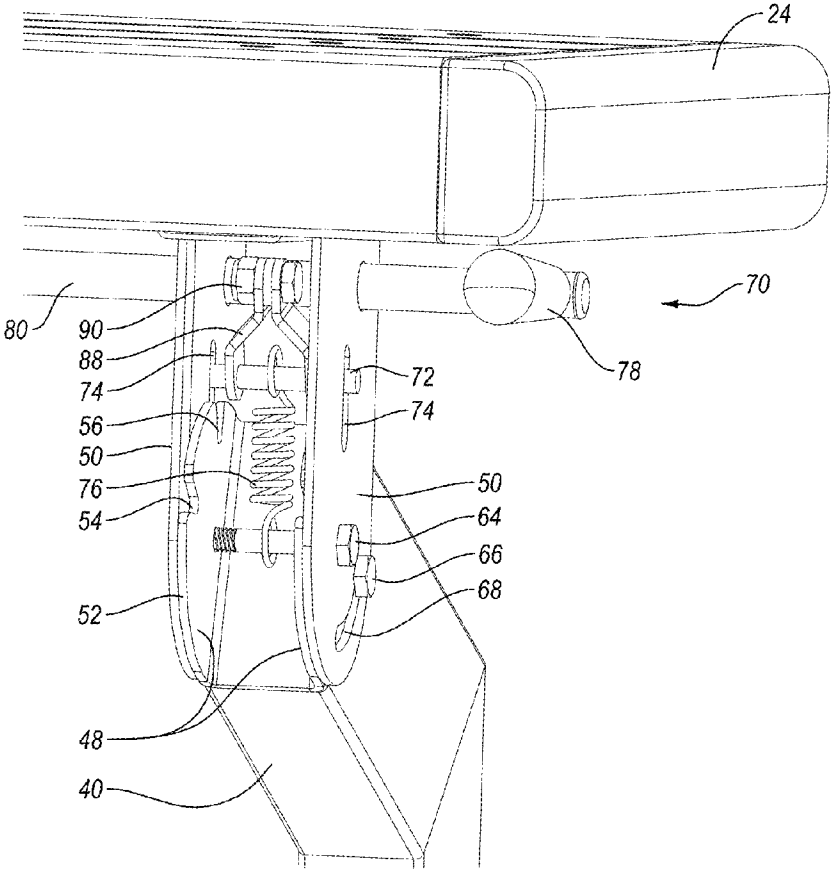
FIG. 7 is a perspective view of a portion of the combination bench and table shown in FIG. 6, illustrating the handle and locking mechanism in a second position.
Figure 8:
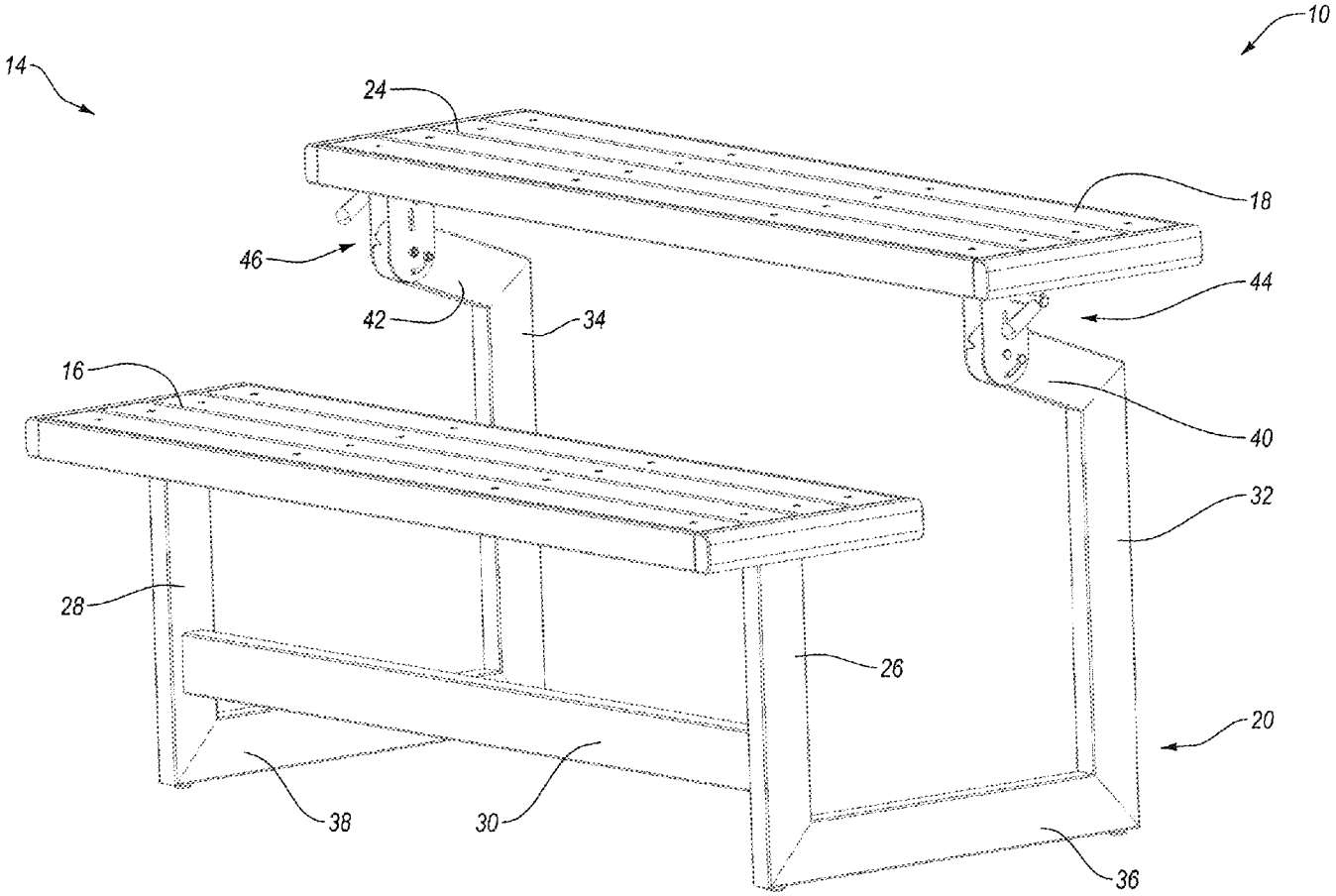
FIG. 8 is a perspective view of still another exemplary embodiment of the combination bench and table.
Figure 9:
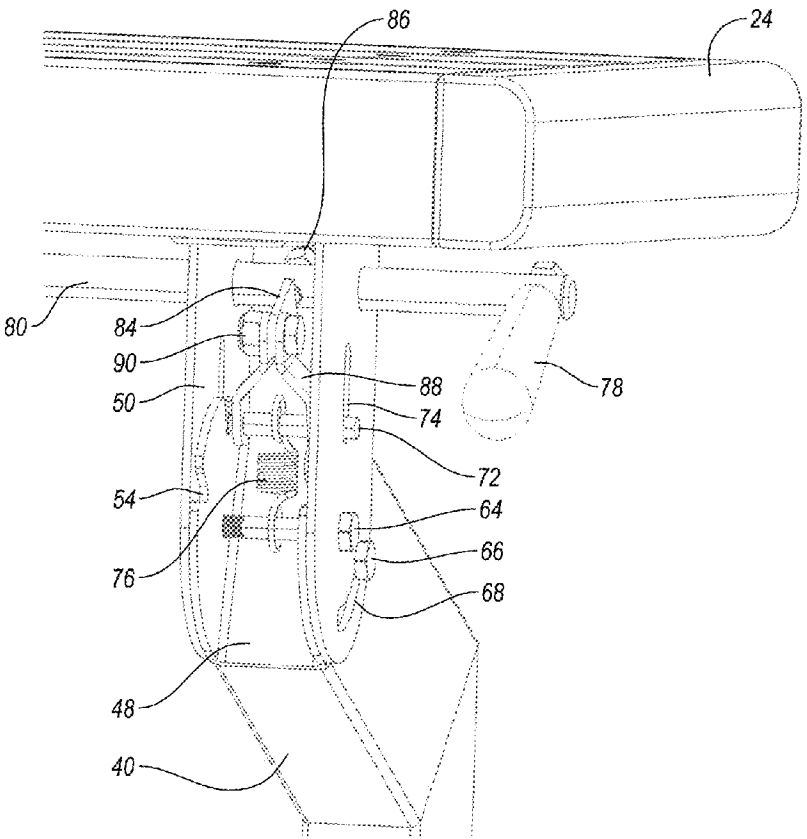
FIG. 9 is an enlarged perspective view of a portion of the combination bench and table shown in FIG. 8.
Figure 10:
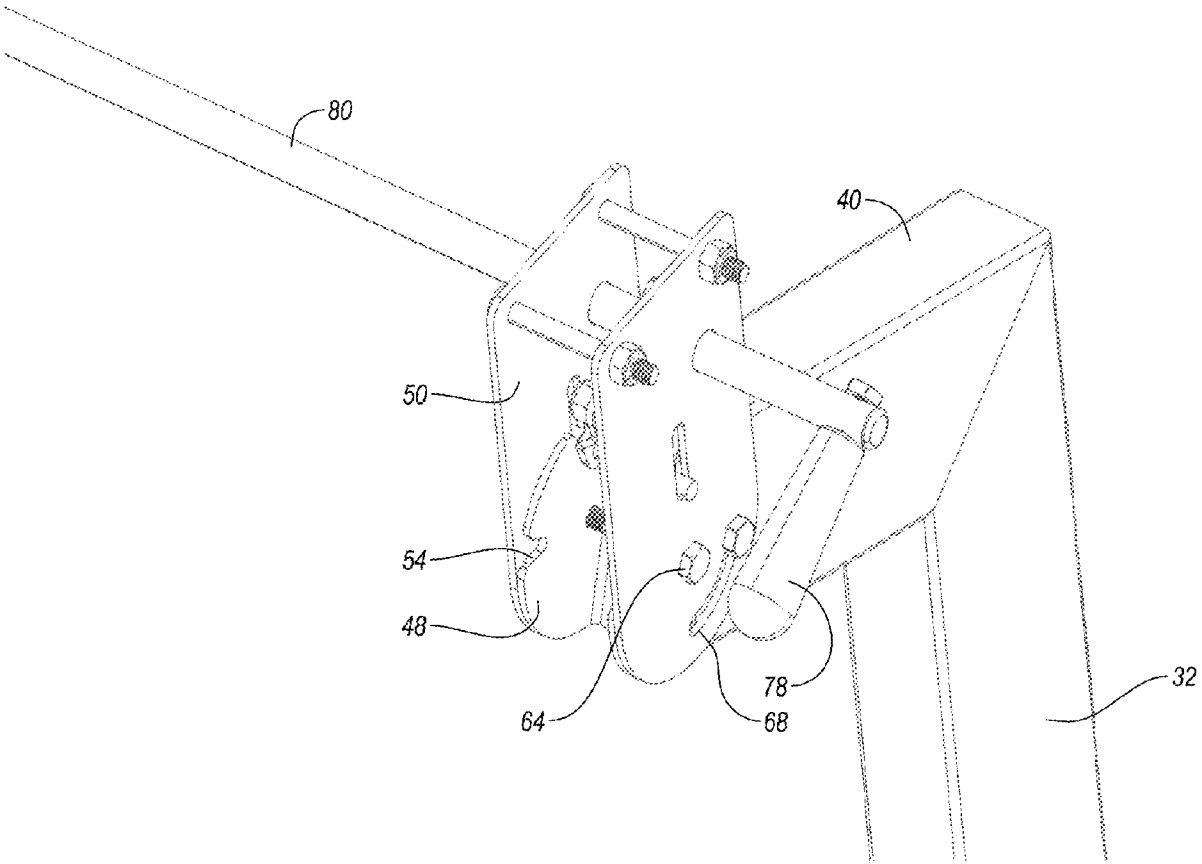
FIG. 10 is a perspective view of a portion of the combination bench and table shown in FIG. 9.
Figure 11:
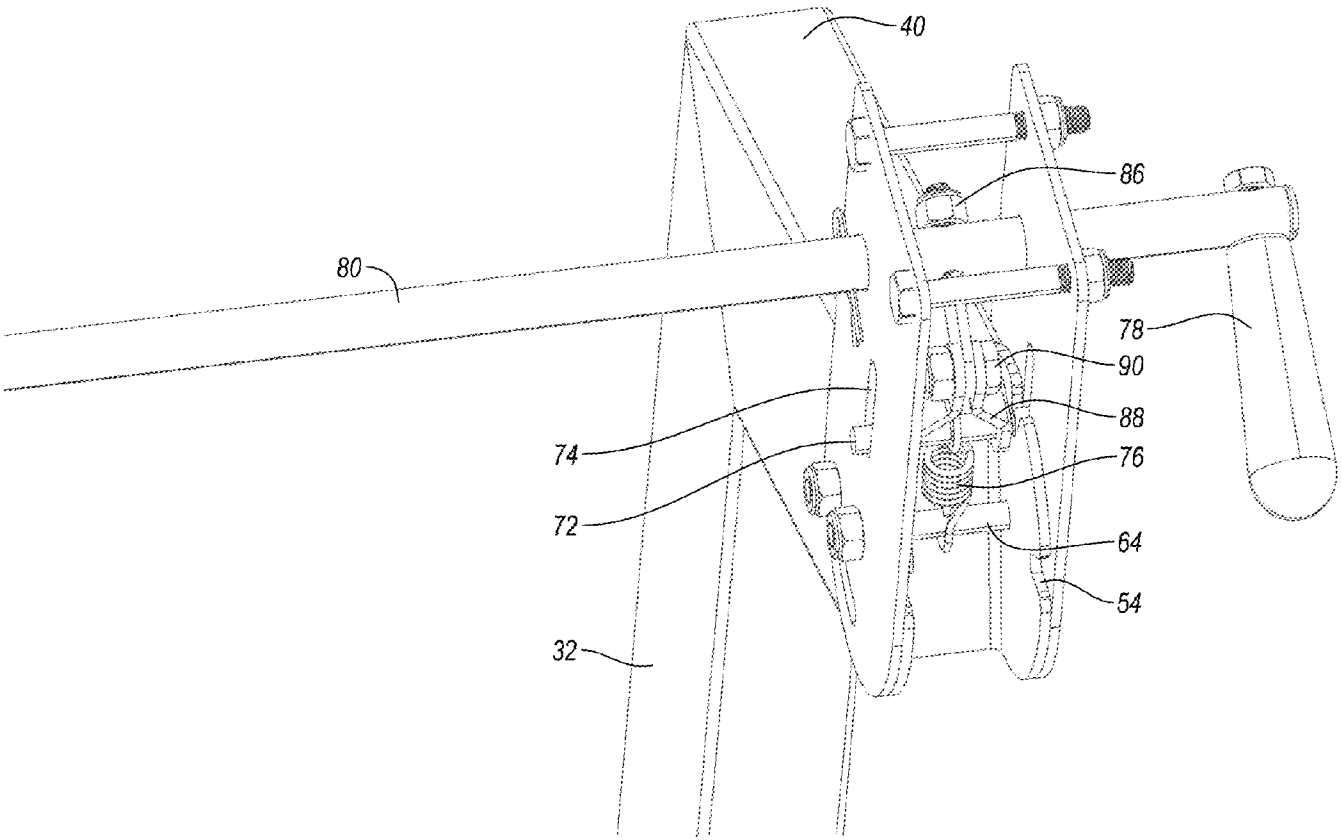
FIG. 11 is another perspective view of the portion of the combination bench and table shown in FIG. 10.
Figure 13:
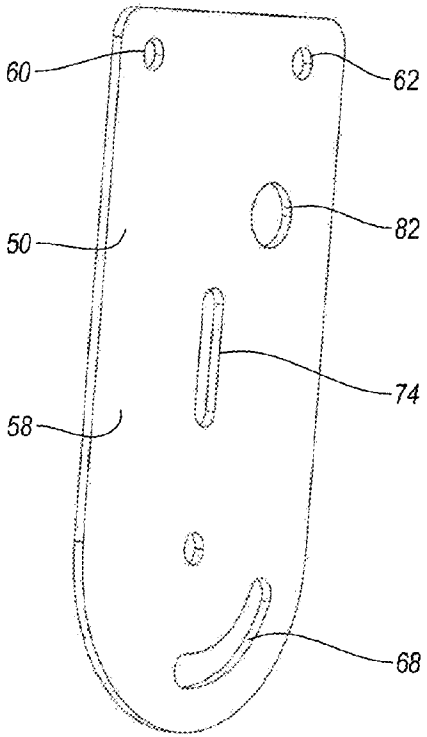
FIG. 13 is an enlarged perspective view of a portion of the combination bench and table shown in FIG. 10.
Figure 12:
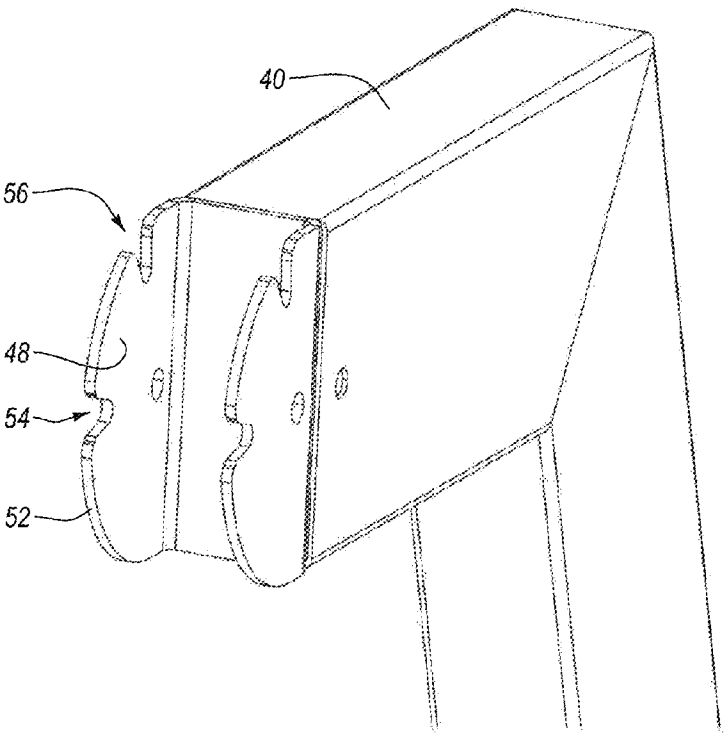
FIG. 12 is an enlarged perspective view of a portion of the combination bench and table shown in FIG. 10.

The first and second connecting assemblies 44, 46 may include a first bracket 48 connected to the cantilever support member 40, 42 and a second bracket 50 connected to the platform 24. As best seen in FIG. 12, the first bracket 48 may be connected to the end of the cantilever support member 40, 42 and it may include a rounded or curved outer surface 52. The curved outer surface 52 may include a plurality of receiving portions such as a first receiving portion 54 and a second receiving portion 56. The second bracket 50, as best seen in FIG. 13, may include a body 58 with a plurality of openings or apertures. For example, the body 58 may include openings 60, 62 that facilitate connecting the bracket 50 to the platform 24. As seen in FIGS. 6 and 7, for example, the second bracket 50 may also have a generally U-shaped configuration. In particular, the second bracket 50 may include two body portions 58 that are spaced apart to form the sides of the bracket with the generally U-shaped configuration.

The first and second connecting assemblies 44, 46 are preferably connected by a fastener or pin 64. In particular, the fastener 64 preferably rotatably or pivotally connects the first and second brackets 48, 50 of the connecting assemblies 44, 46. The movement of the first and second brackets 48, 50 is preferably limited to a specific range of motion. For example, the range of motion may be limited to allow the platform 22 to move between the bench configuration and the table configuration. The range of motion may be limited by an engaging member 66 disposed within a guide 68. For example, the engaging member 66 may be connected to the first bracket 48 and it may be disposed with the guide 68 formed in the second bracket 50. Thus, when the engaging member 66 contacts or abuts the ends of the guide 68, it may prevent further movement of the second bracket 50 relative to the first bracket 48.

The combination bench and table 10 may also include a locking mechanism 70 that is movable between a locked and an unlocked position. The locking mechanism 70 may be used to lock the platform 24 in one or more positions, such as when the platform forms the table top 18 in the table configuration or the backrest 22 in the bench configuration. Advantageously, the locking mechanism 70 may secure the platform 24 in either or both of these positions. The locking mechanism 70 may also lock the platform in other positions depending, for example, upon the intended use of the combination bench and table 10.

The locking mechanism 70 may include a locking member 72 that moves within a guide 74. The guide 74 may be formed in the second bracket 50 and the locking member is preferably movable between a locked position and an unlocked position. For example, when the guide 74 is generally aligned with one of the receiving portions 54, 56, that may allow the locking member 72 to be disposed in one or the receiving portions. When the locking member 72 is in one of the receiving portions 54, 56, the locking member may prevent the rotational or pivotal movement of the brackets 48, 50, which may lock the connecting assembly 44, 46 in a fixed position. On the other hand, when the locking member 70 is not disposed within one of the receiving portions 54, 56, then the bracket 50 may rotate relative to the bracket 48 and the connecting assembly 44, 46 is unlocked.

Figure 4:
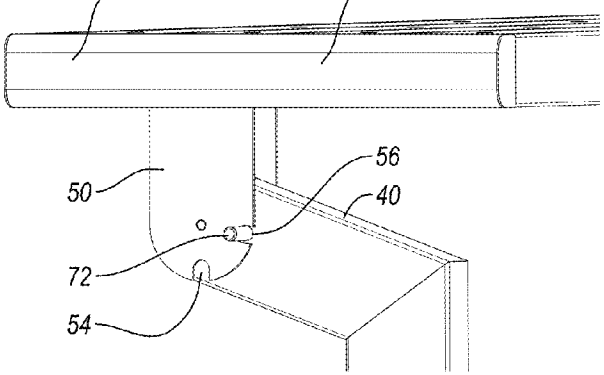
FIG. 4 is an enlarged perspective view of a portion of the combination bench and table shown in FIG. 1.
Figure 3:
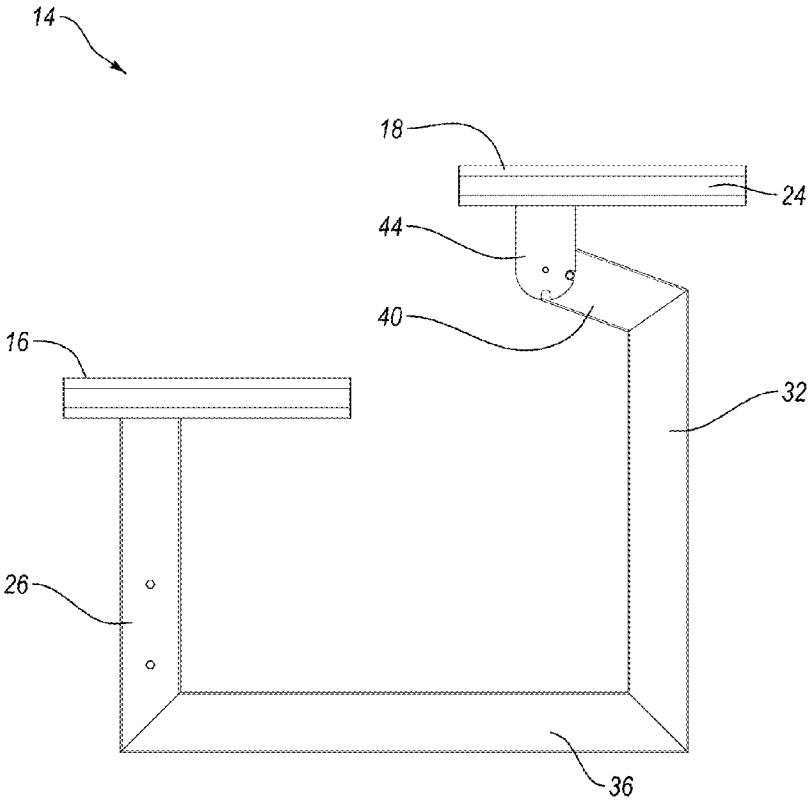
FIG. 3 is a side view of the combination bench and table shown in FIG. 1.

An exemplary embodiment of the locking mechanism is shown in FIGS. 1-4. As best seen in FIG. 4, in the table configuration, the first receiving portion 54 may be disposed at least proximate the lower portion of the second bracket 50 and the second receiving portion 56 may be disposed in the side of the second bracket towards the first cantilever support member 40. In this example, the locking member 72 may be removed from the second receiving portion 56 to allow the platform 24 to move or pivot. The locking member 72 may also be used to secure the backrest 22 in the bench configuration.

A biasing member 76 may be used to bias the locking member 70 into a locked or unlocked position, such as shown in FIGS. 6-7, 9, 11 and 14. For instance, the biasing member 76 may comprise a spring that is connected to the locking member 72 and the fastener 64. The biasing member 76 may apply a force that urges the locking member 72 into a receiving portion, such as the first or second receiving portion 54, 56. Therefore, when the locking member 72 is aligned with the first or second receiving portion 54, 56, the biasing member 76 may cause the locking member to move within the guide 74 and into the first or second receiving portion. The biasing member 76 may also help maintain the locking member 72 within the receiving portion 54, 56, which may help keep the connecting assembly 44, 46 in the locked position.

A handle 78 may be used to lock and/or unlock the connecting assemblies 44, 46, which may allow the combination bench and table 10 to be moved between the bench and table configurations. As shown in FIGS. 6 and 7, the handle 78 may be connected to a rod 80 that extends through an opening 82 in the second bracket 50. A flange 84 may be attached to the rod 80 by a first fastener 86 and the flange may be connected to a connecting member 88 by a second fastener 90. The flange 84 may be non-rotatably connected to the rod 80 while the connecting member 88 may be rotatably connected to the flange. The connecting member 88, which may include a pair of angled flanges with a generally Y-shaped configuration, may be connected to the locking member 72. In particular, the locking member 72 may be inserted through openings in the connecting member 88. The locking member 72 may be connected to the connecting member 88 by an interference fit, threads, welding, adhesives and the like.

The handle 78 may be used to move the locking member 72 between a locked position and an unlocked position. For example, as seen in FIG. 6, the handle 78 may be disposed in a first position and the locking member 72 may be disposed in the second receiving portion 56. In this configuration, for instance, the platform 24 may be disposed in the table configuration. As shown in FIG. 7, the handle 78 may be manipulated, such as rotating the handle towards the platform 24, which may cause the interconnected flange 84, connecting member 88 and locking member 72 to move. Preferably, movement of the handle 78 causes the locking member 72 to move from the locked position to an unlocked position. This may allow the second bracket 50 to rotate relative to the first bracket 48, which may allow the platform 22 to be moved.

In greater detail, the rotation of the handle 78 may cause the locking member 72 to be moved from the locked position as shown in FIG. 6 to the unlocked position as shown in FIG. 7. When the locking member 72 is in the unlocked position, the platform 24 may be moved between one or more positions. If desired, the locking member 72 may slide along the curved outer surface 52 of the first bracket 48 when the platform 24 is being moved between positions. The locking member 72 may also be spaced apart from the first bracket 48 when the locking mechanism is in the unlocked position.

As discussed above, the biasing member 76 may bias the locking member 72 into a locked position. In addition, the biasing member may bias the handle 78 into a first position in which the platform 24 is disposed in a fixed position. Thus, movement of the handle 78 from a locked position to an unlocked position may require that sufficient force be applied to the handle to overcome the biasing member 76.

Figure 5:
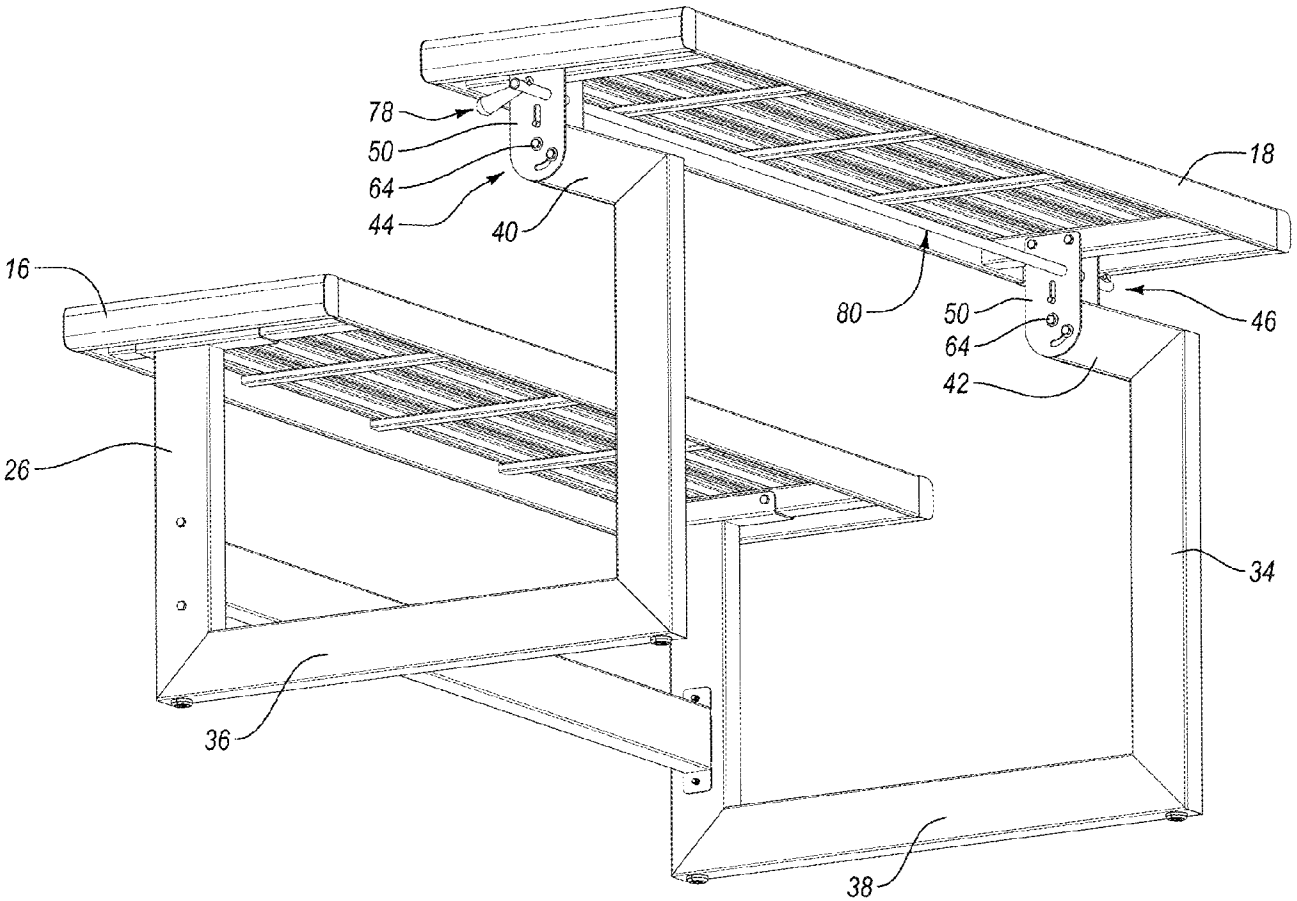
FIG. 5 is a lower perspective view of another exemplary embodiment of the combination bench and table.

As seen in FIG. 5, the rod 80 may be connected to both the first connecting assembly 44 and the second connecting assembly 46. This may allow the rod 80 to simultaneously lock and/or unlock both of the connecting assemblies 44, 46. This may allow a single user to quickly and easily move the platform 24 between the bench and table configurations. In addition, a handle 78 may be disposed on each end of the rod 80. Preferably, either of the handles 78 may be used to lock and/or unlock the connecting assemblies 44, 46. Advantageously, the handles 78 may allow the platform 24 to be readily adjusted from either side of the combination bench and table 10, which may facilitate use of the combination bench and table 10. One of ordinary skill in the art, after reading this disclosure, may appreciate that any suitable number of connecting assemblies, handles and rods may be used depending, for example, upon the configuration and intended use of the combination bench and table. Further, the handles and connecting assemblies may be independent from each other if desired.

Figure 14:
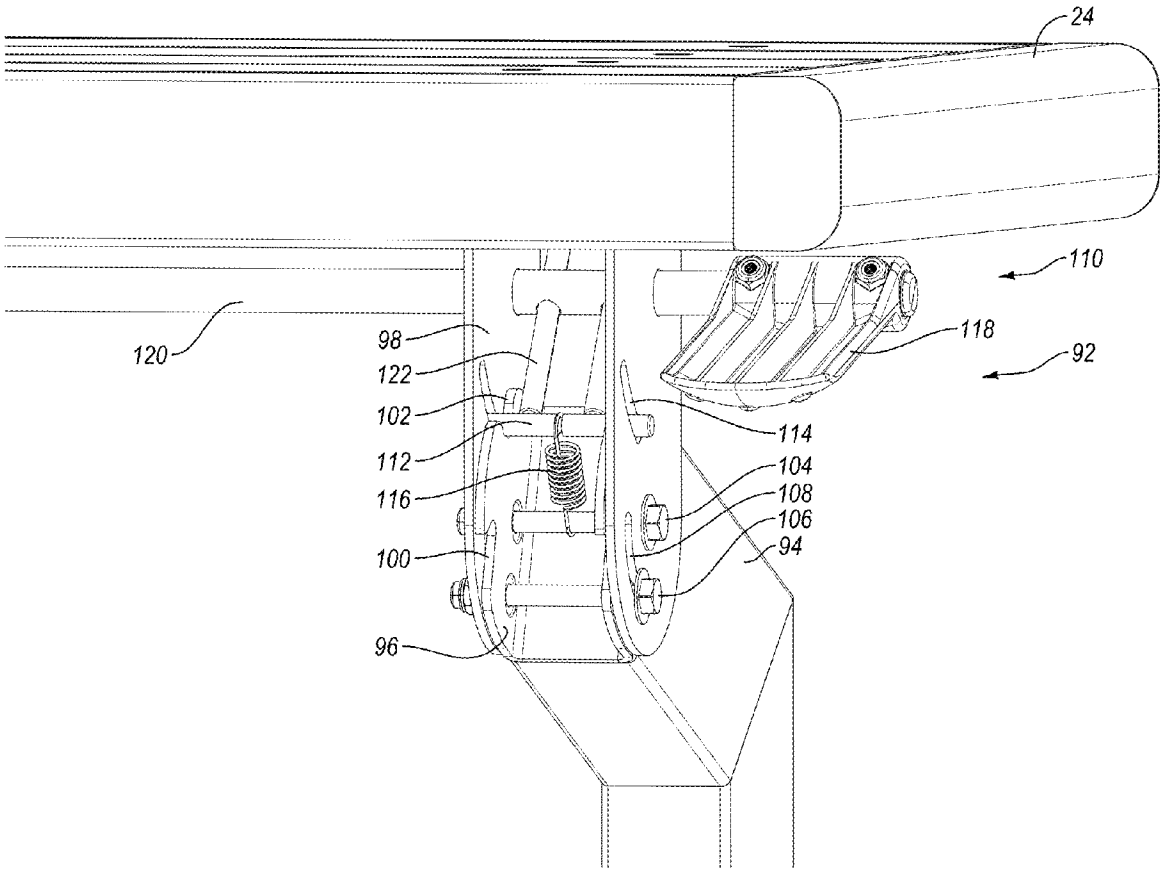
FIG. 14 is perspective view of a portion of yet another exemplary embodiment of the combination bench and table.

It will be appreciated that the combination bench and table 10 may have other suitable shapes, sizes, configurations and arrangements. For example, as shown in FIG. 14, an exemplary connecting assembly 92 may be connected to a cantilever support member 94 and the platform 24. In greater detail, the connecting assembly 92 may include a first bracket 96 connected to the cantilever support member 94 and a second bracket 98 connected to the platform. The first bracket 96 may include a first receiving portion 100 and a second receiving portion 102, and a fastener or pin 104 may be used to connect the brackets 96, 98. An engaging member 106 may be disposed within the guide 108 to limit the movement of the connecting assembly 92. The connecting assembly 92 may also include a locking mechanism 110 with a locking member 112 movable within a guide 114. Further, the locking mechanism 110 may include a biasing member 116 that is used to bias the locking member 112 into a locked position.

The connecting assembly 92 may utilize a handle 118 to lock and/or unlock the locking mechanism 110. In particular, the handle 118 may be connected to a rod 120 that is connected to the locking member 112 by a connecting structure 122. The connecting structure 122 may include one or more elongated rods or tubes that connect the rod 120 and the locking member 112. The rotation of the handle 118 may cause the rod 120, the connecting structure 122 and the locking member 112 to move. For example, the rotation of the handle 118 may cause the locking member 112 to move within the guide 114 and away from the second receiving portion 102. This may allow the platform 24 to move or pivot, such as from the table configuration to the bench configuration.

As described above, the combination bench and table 10 may be constructed from relatively few components, which may simplify the manufacturing and assembly process. For example, the combination bench and table 10 may be constructed from the primary components of the seat 16, the frame 20, the platform 24, and the connecting assemblies 44, 46, 92. This may also allow consumers to purchase the combination bench and table 10 in an unassembled or partially unassembled configuration, and then assemble the combination bench and table at home, in a workshop or the like. This may significantly reduce shipping, transportation and storage costs. It will be appreciated that the combination bench and table 10 may include any suitable number of components depending, for example, upon the intended use or configuration of the combination bench and table.

The combination bench and table 10 may include only a small number of movable parts and components. For instance, the platform 24 may pivot or rotate about a single axis and this axis is preferably disposed proximate the bottom portion of the backrest 22 and the front edge of the table top 18. The axis may also be perpendicularly disposed to the end of the first and second cantilever support members 40, 42. In addition, the axis may be generally vertically disposed above a midpoint of the first and second connecting members 36, 36 that connect the legs 26, 28 and the upright support members 32, 34. Significantly, the positioning of the axis may help create a stable and secure bench and table 10.

In greater detail, the axis may be disposed a distance from the front edge of the table top 18 or the bottom of the backrest 22 that is generally equal to or less than a length of the second bracket 50. The axis may also be disposed a distance from the front edge of the table top 18 or the bottom of the backrest 22 by a distance that is generally equal to or less than a length of the handle 78. This may allow the end of the handle 78 to be generally aligned with the front edge of the table top 18 or the bottom of the backrest 22 when the handle is in the unlocked position. This positioning of the handle 78 may allow the handle to be easily grasped and used.

The axis is also preferably disposed above a plane generally aligned with an upper surface of the seat 16. The axis may also be disposed a greater distance from the connecting members 36, 38 of the frame 20 that the upper ends of the first and second generally upright support members 32, 34. Further, when the platform 22 forms the backrest 22, the axis may be generally horizontally aligned with the bottom edge or portion of the backrest.

In operation of the exemplary embodiment shown in FIGS. 5 to 11, a user may grasp the handle 78 and move the locking mechanism 70 from the locked position to the unlocked position. This may unlock connecting assemblies 44, 46 and allow the platform 24 to move relative to or rotate about the pivot axis. The platform 24 may then be moved into the bench configuration to form the backrest 22 and/or the table configuration to form the table top 18. The handle 78 may be released when the platform 22 is moved from its original position and it may automatically lock when disposed in its newly desired position. The user may also release the handle 78 when the platform 24 is in the desired position. The other embodiments may operate in a similar manner.

Significantly, the combination bench and table 10 may be relatively straightforward to use and easy to operate. Further, the combination bench and table 10 may be disposed in a number of different configurations and arrangements. For example, a plurality of the combination bench and tables 10 may be aligned in one or more rows in the table configuration. In addition, the combination bench and tables 10 may be aligned in a facing configuration to form a conventional picnic table when in the table configuration. Further, the combination bench and tables 10 may be aligned in rows of benches when in the bench configuration. Therefore, it will be understood that one or more of the combination bench and tables 10 may have a number of different uses, configurations and arrangements. It will also be understood that while the combination bench and table 10 may have the shape, size, configuration and arrangement shown in the accompanying drawings and described above, it may also have other suitable shapes, sizes, configurations and arrangements depending, for example, upon the intended use of the combination bench and table. Therefore, one of ordinary skill in the art may appreciate, after reviewing this disclose, that the combination bench and table 10 may include additional or fwer components, structures and the like.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A combination bench and table that is movable between a bench configuration and a table configuration, the combination bench and table comprising:

a seat;

a platform movable between a first position in which it forms a backrest for the bench and a second position in which it forms a table;

a frame connecting the seat and the platform, the frame comprising:

a first leg that supports the seat;

a first support member that supports the platform;

a first connecting member connecting the first leg and the first support member; and a first cantilever support member connected to an upper portion of the first support member, the first cantilever support member angled inwardly and upwardly relative to the seat;

a first connecting assembly pivotally connecting the platform to the first cantilever support member, the first connecting assembly connected to the lower portion of the backrest and proximate a front edge of the table, the platform pivoting about an axis of rotation disposed in a fixed location at least proximate an upper portion of the first cantilever support member and the lower portion of the backrest or the front edge of the table; and a locking mechanism that locks the platform in the bench configuration or in the table configuration, the locking mechanism including a locking member that locks the first connecting assembly in a locked position, the locking member including a handle that can be rotated to unlock the locking mechanism, the locking member selectively disposed in a first receiving portion to lock the platform in the bench configuration, the locking member selectively disposed in a second receiving portion to lock the platform in the table configuration.

2. The combination bench and table as in claim 1, wherein the first support member and the first cantilever support member are disposed behind the backrest when the combination bench and table are disposed in the bench configuration.

3. The combination bench and table as in claim 1, wherein the first support member and the first cantilever support member are disposed underneath the platform when the combination bench and table are disposed in the table configuration.

4. The combination bench and table as in claim 1, wherein the first cantilever support member extends upwardly at about a 30 degree angle.

5. The combination bench and table as in claim 1, wherein the first cantilever support member includes an upper end that is generally aligned with a proximal edge of the table and a lower end that is generally aligned with a distal edge of the table when the combination bench and table are disposed in the table configuration.

6. The combination bench and table as in claim 1, wherein the axis is generally vertically aligned with a midpoint of the first connecting member.

7. The combination bench and table as in claim 1, wherein the axis is generally horizontally aligned with a lower edge of the backrest when the combination bench and table are disposed in the bench configuration.

8. The combination bench and table as in claim 1, wherein the first connecting assembly includes a bracket that is used to pivotally connected the first cantilever support member and the platform about an axis; and wherein the axis is spaced apart from a front edge of the table or the bottom edge of the backrest by a distance that is less than a length of the bracket.

9. The combination bench and table as in claim 1, further comprising:

a second leg that supports the seat;

a second support member that supports the platform;

a second connecting member connecting the second leg and the second support member;

a second cantilever support member connected to an upper portion of the second support member, the second cantilever support member angled inwardly and upwardly relative to the seat; and a second connecting assembly pivotally connecting the platform to the second cantilever support member, the second connecting assembly connected to the lower portion of the backrest and proximate a front edge of the table, the axis of rotation disposed in a fixed location at least proximate an upper portion of the second cantilever support member and the lower portion of the backrest or the front edge of the table.

10. An apparatus that is movable between a bench configuration and a table configuration, the apparatus comprising:

a seat;

a platform that is movable between a first position in which it forms a backrest for the bench and a second position in which it forms a table;

a frame connecting the seat and the platform, the frame comprising:

a seat support structure;

a platform support structure, a connecting member connecting the seat support structure and the platform support structure; and an upwardly angled cantilever support member connected to an upper portion of the platform support structure, the cantilever support member angled inwardly and upwardly relative to the seat;

a connecting assembly pivotally connecting the platform to the cantilever support member about an axis, the axis being disposed in a fixed proximate a lower portion of the backrest and proximate a front edge of the table, the platform pivoting about an axis of rotation disposed in a fixed location at least proximate an upper portion of the cantilever support member and the lower portion of the backrest or the front edge of the table; and a locking mechanism that locks the platform in the bench configuration and in the table configuration, the locking mechanism comprising:

a guide, a locking member movable within the guide and selectively disposed in a first receiving portion to lock the platform in the bench configuration and a second receiving portion to lock the platform in the table configuration; and a biasing member connected to the locking member to bias the locking member into a locked position.

11. The apparatus as in claim 10, wherein the platform support structure and the cantilever support member are disposed behind the backrest when the apparatus is disposed in the bench configuration.

12. The apparatus as in claim 10, wherein the platform support structure and the cantilever support member are disposed underneath the platform when the apparatus is disposed in the table configuration.

13. The apparatus as in claim 10, wherein the upwardly angled cantilever support member is disposed at about a 30 degree angle.

14. The apparatus as in claim 10, wherein the cantilever support member includes an upper end that is generally aligned with a proximal edge of the table and a lower end that is generally aligned with a distal edge of the table when the apparatus is disposed in the table configuration.

15. The apparatus as in claim 10, wherein the axis of the connecting assembly is generally vertically aligned with a midpoint of the connecting member.

16. The apparatus as in claim 10, wherein the axis of the connecting assembly is generally horizontally aligned with a lower edge of the backrest when the apparatus is disposed in the bench configuration.

17. The apparatus as in claim 10, wherein the locking mechanism further comprises a handle that can be rotated to unlock the locking mechanism.

18. The apparatus as in claim 10, wherein the connecting assembly includes a bracket that is used to pivotally connected the cantilever support member and the platform about the axis; and wherein the axis is spaced apart from a front edge of the table and the bottom edge of the backrest by a distance that is less than a length of the bracket.

* * * * *

UNITED STATES PATENT AND TRADEMARK OFFICE

CERTIFICATE OF CORRECTION

PATENT NO. : 8,720,990 B2
APPLICATION NO. : 13/170124
DATED : May 13, 2014
INVENTOR(S) : Boydston et al.

It is certified that error appears in the above-identified patent and that said Letters Patent is hereby corrected as shown below:

In the Specification:

In Column 5, Line 21, delete “is” and insert -- is a --, therefor.

In Column 11, Line 64, delete “fwer” and insert -- fewer --, therefor.

In the Claims:

In Column 13, Line 31, in Claim 10, delete “structure,” and insert -- structure; --, therefor.

In Column 14, Line 4, in Claim 10, delete “guide,” and insert -- guide; --, therefor.

Signed and Sealed this
Fifth Day of August, 2014

Michelle K. Lee

Michelle K. Lee
*Deputy Director of the United States Patent and Trademark Office*